US008371458B2

(12) United States Patent
Yu

(10) Patent No.: US 8,371,458 B2
(45) Date of Patent: Feb. 12, 2013

(54) CEILING RACK

(75) Inventor: Stephen Yu, Taoyuan (TW)

(73) Assignee: Clair Home Products Inc., Taoyuan County (TW)

( * ) Notice: Subject to any disclaimer, the term of this patent is extended or adjusted under 35 U.S.C. 154(b) by 260 days.

(21) Appl. No.: 13/004,893

(22) Filed: Jan. 12, 2011

(65) Prior Publication Data

US 2012/0175331 A1 Jul. 12, 2012

(51) Int. Cl.

| | |
|---|---|
| ***A47F 5/08*** | (2006.01) |
| *A47F 5/00* | (2006.01) |
| *A47B 5/00* | (2006.01) |
| *G09F 7/18* | (2006.01) |
| *A47H 1/10* | (2006.01) |

(52) U.S. Cl. ..... 211/117; 211/175; 108/149; 52/39; 248/317

(58) Field of Classification Search ..... 211/113, 211/116, 117, 118, 119, 181.1, 189, 190.03, 211/133.5, 175; 248/317, 323, 326, 327; 312/245, 247; 52/39, 36.4; 108/149; 224/405
See application file for complete search history.

(56) References Cited

U.S. PATENT DOCUMENTS

| | | | | |
|---|---|---|---|---|
| 1,202,166 | A * | 10/1916 | Corbett | 211/117 |
| 2,524,916 | A * | 10/1950 | Loos | 269/97 |
| 2,947,585 | A * | 8/1960 | Fazio | 108/44 |
| 3,139,045 | A * | 6/1964 | Rojakovick | 108/109 |
| 3,953,015 | A * | 4/1976 | Taylor et al. | 269/46 |
| 4,061,092 | A * | 12/1977 | Jacobsen et al. | 108/149 |
| 4,973,021 | A * | 11/1990 | Schuite | 248/495 |
| 5,351,926 | A * | 10/1994 | Moses | 248/354.5 |
| 5,713,157 | A * | 2/1998 | van Leeuwen et al. | 52/39 |
| 6,409,031 | B1 * | 6/2002 | Wynne | 211/119 |
| D459,926 | S * | 7/2002 | Mikich et al. | D6/513 |
| 6,435,105 | B1 * | 8/2002 | Mikich et al. | 108/42 |
| D470,353 | S * | 2/2003 | Mikich et al. | D6/513 |
| 6,715,427 | B2 * | 4/2004 | Mikich et al. | 108/42 |
| 6,935,600 | B1 * | 8/2005 | Barrepski | 248/317 |
| D525,811 | S * | 8/2006 | Nawrocki | D6/513 |
| 7,152,535 | B2 * | 12/2006 | Mikich et al. | 108/42 |
| 7,228,669 | B1 * | 6/2007 | Yaraschefski | 52/506.06 |
| 7,320,453 | B2 * | 1/2008 | Berlyn et al. | 248/328 |
| 7,357,262 | B2 * | 4/2008 | Fratilla | 211/117 |
| 7,810,438 | B2 * | 10/2010 | Ryberg | 108/42 |
| 2002/0023888 | A1 * | 2/2002 | Wynne et al. | 211/119 |
| 2002/0043189 | A1 * | 4/2002 | Mikich et al. | 108/149 |
| 2003/0178543 | A1 * | 9/2003 | Lamparter | 248/326 |

(Continued)

*Primary Examiner* — Joshua J Michener
*Assistant Examiner* — Devin Barnett
(74) *Attorney, Agent, or Firm* — CKC & Partners Co., Ltd.

(57) ABSTRACT

A ceiling rack includes a pair of transverse beams parallel to each other, at least one mesh unit and at least four supporting units. Each transverse beam has a side wall and a U-shaped hook body, and an assembly groove having an opening on a top surface thereof is formed therebetween. The mesh unit has a U-shaped end body at two opposite end portions thereof, which is assembled in the assembly groove and engaged with the U-shaped hook body. The supporting units are assembled between the side walls of the two opposite end portions of the transverse beam and the ceiling. With the U-shaped end body, the U-shaped hook body and the assembly groove, the mesh unit can be assembled in the assembly groove and engaged with the U-shaped hook body without any locking element, thereby providing the convenience of assembly and disassembly.

8 Claims, 5 Drawing Sheets

U.S. PATENT DOCUMENTS

2004/0182291 A1* 9/2004 Mikich et al. ..... 108/149
2005/0188903 A1* 9/2005 Ryberg ..... 108/149
2006/0070967 A1* 4/2006 Schaubeck et al. ..... 211/187
2007/0007223 A1* 1/2007 Thrush et al. ..... 211/118
2007/0062896 A1* 3/2007 Richardson et al. ..... 211/117
2007/0119805 A1* 5/2007 Nawrocki ..... 211/119
2007/0205169 A1* 9/2007 Fratilla ..... 211/117
2008/0230499 A1* 9/2008 Jasniy ..... 211/119
2009/0255889 A1* 10/2009 Geffe ..... 211/113
2011/0186533 A1* 8/2011 Thrush et al. ..... 211/113
2012/0145659 A1* 6/2012 Mansor ..... 211/116
2012/0181240 A1* 7/2012 Crowley ..... 211/26

* cited by examiner

CEILING RACK

BACKGROUND

1. Field of Invention

The present invention relates to a rack, and particularly to a ceiling rack.

2. Description of Related Art

While working and resting in a room, common people in general only use the middle space and lower space of the room, and seldom use the upper space thereof. A ceiling rack is fixed on the ceiling and is suspended downward, so that in a room, such as a garage, the upper space which is seldom used can be used for placing tools, articles, etc, thereby making the most use of the space in the room.

The ceiling rack generally includes a transverse beam, a mesh unit fixed on the transverse beam and supporting units mounted between the transverse beam and the ceiling. However, with respect to a conventional ceiling rack, the mesh unit thereof is locked on the transverse beam by using the supporting units with a plurality of fixing elements, e.g. screws, and it is inconvenient to assemble and disassemble. The mesh unit is a mesh body formed merely by intersection of longitudinal wires and latitudinal wires of small diameters, wherein the bearing capacity of the wires is small, and thus the bearing capacity of the mesh unit is limited for holding articles. Moreover, the conventional ceiling rack generally has no additional frame body arranged for holding articles, and thus the capacity thereof for accommodating articles cannot be expanded.

The aforementioned reasons result in poor applicability of the conventional ceiling rack.

SUMMARY

An object of the present invention is to provide a ceiling rack for the convenience of assembly and disassembly.

Another object of the present invention is to provide a ceiling rack for increasing bearing capacity.

A further object of the present invention is to provide a ceiling rack for increasing the accommodation capacity.

According to one of the aforementioned objects, an aspect of the present invention is to provide a ceiling rack which includes a pair of transverse beams arranged to be parallel to each other, at least one mesh unit and at least four supporting units. Each transverse beam has a side wall and a U-shaped hook body connected with each other, and an assembly groove is formed between the U-shaped hook body and the side wall. The assembly groove has an opening on a top surface thereof. The mesh unit has a U-shaped end body located at each of the two opposite end portions thereof. The U-shaped end body is assembled in the assembly groove and is engaged with the U-shaped hook body. The supporting units are assembled between the side walls of the two opposite end portions of the transverse beam and the ceiling. With the U-shaped end body disposed on the mesh unit, and the U-shaped hook body and the assembly groove disposed on the transverse beam, the mesh unit can be assembled in the assembly groove of the transverse beam and be engaged with the U-shaped hook body without any locking element, thereby providing the convenience of assembly and disassembly.

According to an embodiment of the present invention, the mesh unit includes at least two longitudinal struts and a plurality of longitudinal wires which are parallel to one another, and includes a plurality of latitudinal wires orthogonally crossed with the longitudinal struts and longitudinal wires. A U-shaped end body is formed at each of the two opposite end portions of each longitudinal strut. With the longitudinal struts disposed on the mesh unit, the bearing capacity of the mesh unit for holding articles can be increased.

According to an embodiment of the present invention, the number of the at least one mesh unit is more than one, and the two longitudinal struts are located respectively at two external sides of each mesh unit. Longitudinal struts of the adjacent mesh units are locked as one body through at least one locking element, so that two adjacent mesh units are joined as one body tightly.

According to an embodiment of the present invention, the supporting unit includes a lower supporting member, a groove member and an upper supporting member. The lower supporting member is fixed on the side wall of the transverse beam through a first fixing element. The groove member has a first end portion and a second end portion opposite to each other. The first end portion is joined and fixed with the lower supporting member through a second fixing element. The upper supporting member is joined and fixed with the second end portion of the groove member through a third fixing element, and a fixing base is formed on a top end of the upper supporting member. The fixing base is fixed on the ceiling through a fourth fixing element, thereby achieving the supporting assembly between the transverse beam and the ceiling.

According to an embodiment of the present invention, a plurality of adjusting holes are formed on the groove member. Different adjusting hole sites can be aligned and joined with respective holes of the lower supporting member and the upper supporting member through the fixing elements, thereby adjusting an overall length of the supporting unit.

According to an embodiment of the present invention, a blocking mechanism is disposed at the end portion of the transverse beam, so as to prevent the mesh unit from falling out of the assembly groove of the transverse beam.

According to an embodiment of the present invention, the blocking mechanism includes a blocking pin and a fixing pin. The blocking pin passes through the side wall and the U-shaped hook body of the transverse beam, and is protruded from the U-shaped hook body. A pin hole is formed on the blocking pin, and the fixing pin is inserted into and fixed in the pin hole. Thus, the blocking pin is positioned and blocks in the assembly groove of the transverse beam, so as to prevent the mesh unit from falling out of the assembly groove.

According to an embodiment of the present invention, an end plug is plugged in the assembly groove at the end portion of the transverse beam. The end plug is located at an external end of the blocking mechanism, for covering the end portion of the assembly groove and maintaining the appearance completeness of the assembly groove.

According to an embodiment of the present invention, the ceiling rack further includes at least two U-shaped frame bodies that are respectively assembled vertically on the side wall of each transverse beam. The two U-shaped frame bodies opposite to each other are used to hold articles, so as to increase the accommodation capacity of the ceiling rack.

According to an embodiment of the present invention, two hook holes are formed on the side wall of the transverse beam. The U-shaped frame body includes a transverse bar and two arm bars connected with two end portions of the transverse bar. The end portion of the arm bar is an L-shaped end portion, and has an inner arm end, a turning arm and an outer arm body which are connected together. The inner arm end is inserted into the hook hole and resists against the inner wall of the side wall. The turning arm is disposed across the hook hole. The outer arm body resists against the external wall of the side wall. Thus, the U-shaped frame body can be joined with the transverse beam without any locking element, thereby providing the convenience of assembly and disassembly.

BRIEF DESCRIPTION OF THE DRAWINGS

In order to make the foregoing as well as other aspects, features, advantages, and embodiments of the present invention more apparent, the accompanying drawings are described as follows.

DETAILED DESCRIPTION

The foregoing as well as the other technical contents, features and functions related to the present invention are presented clearly in the detailed description of the embodiments below with reference to the figures.

Figure 1:
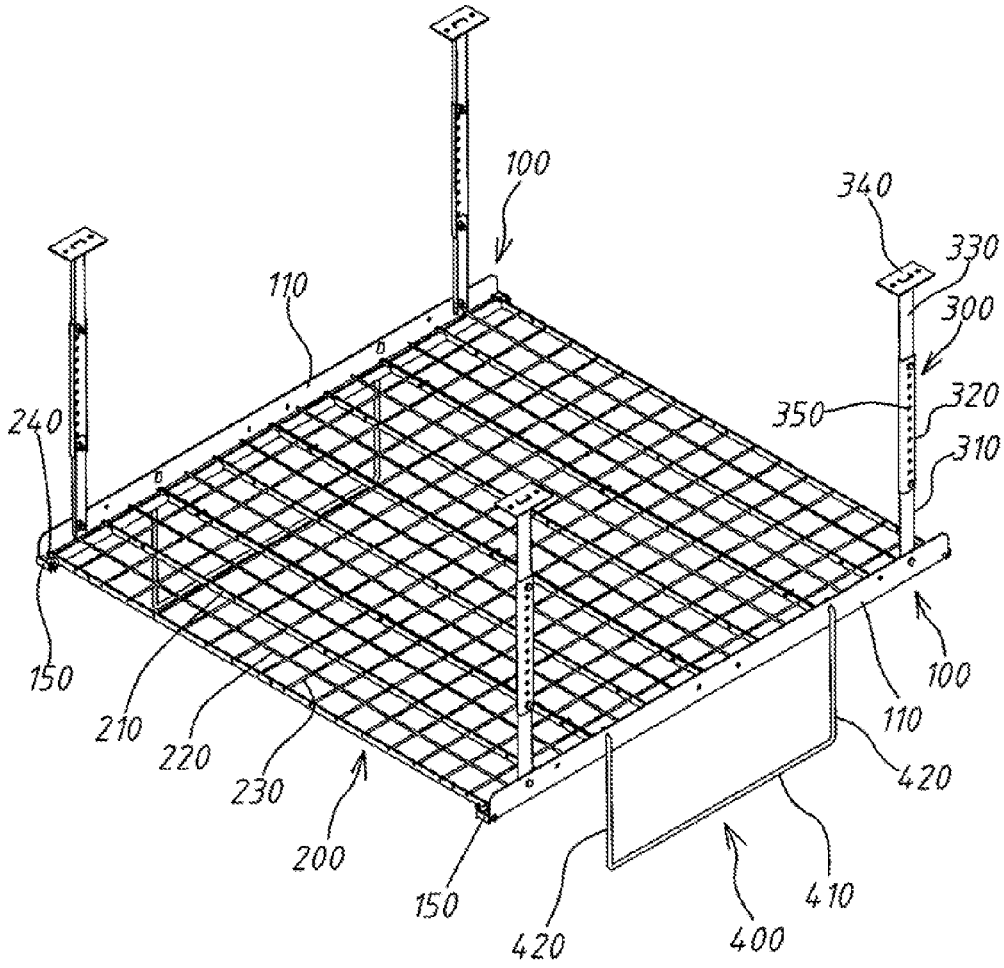
FIG. 1 is a schematic three-dimensional view showing the appearance of a ceiling rack according to an embodiment of the present invention.
Figure 2:
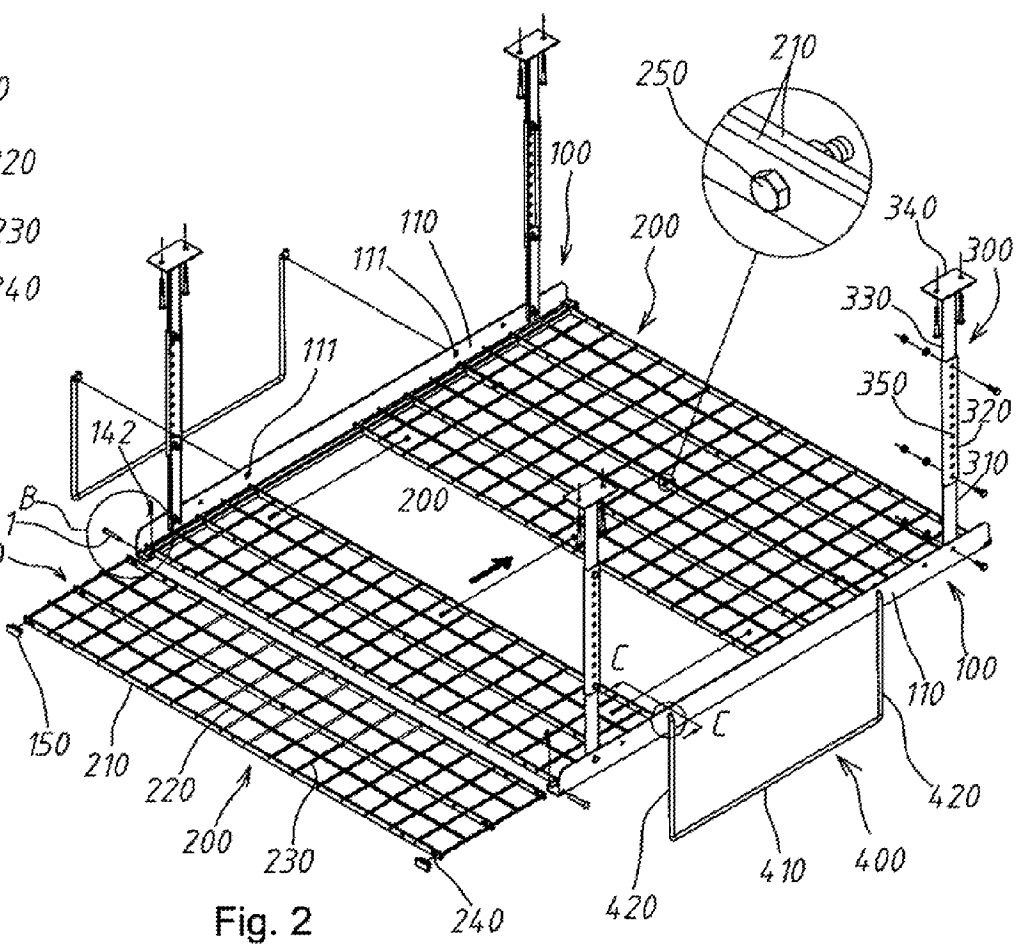
FIG. 2 is a schematic explosive view showing the ceiling rack illustrated in FIG. 1.
Figure 4:
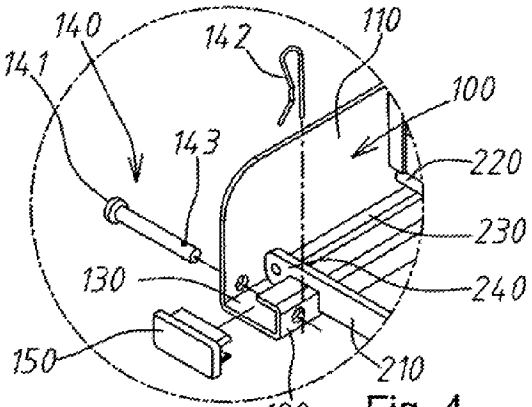
FIG. 4 is an enlarged view showing part B of the ceiling rack illustrated in FIG. 2.
Figure 3:
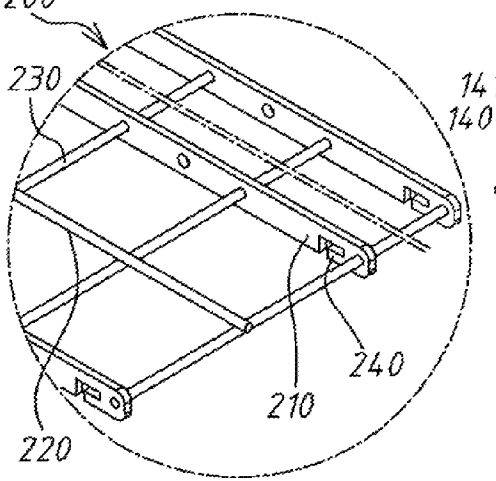
FIG. 3 is an enlarged view showing part A of the ceiling rack illustrated in FIG. 2.
Figure 5:
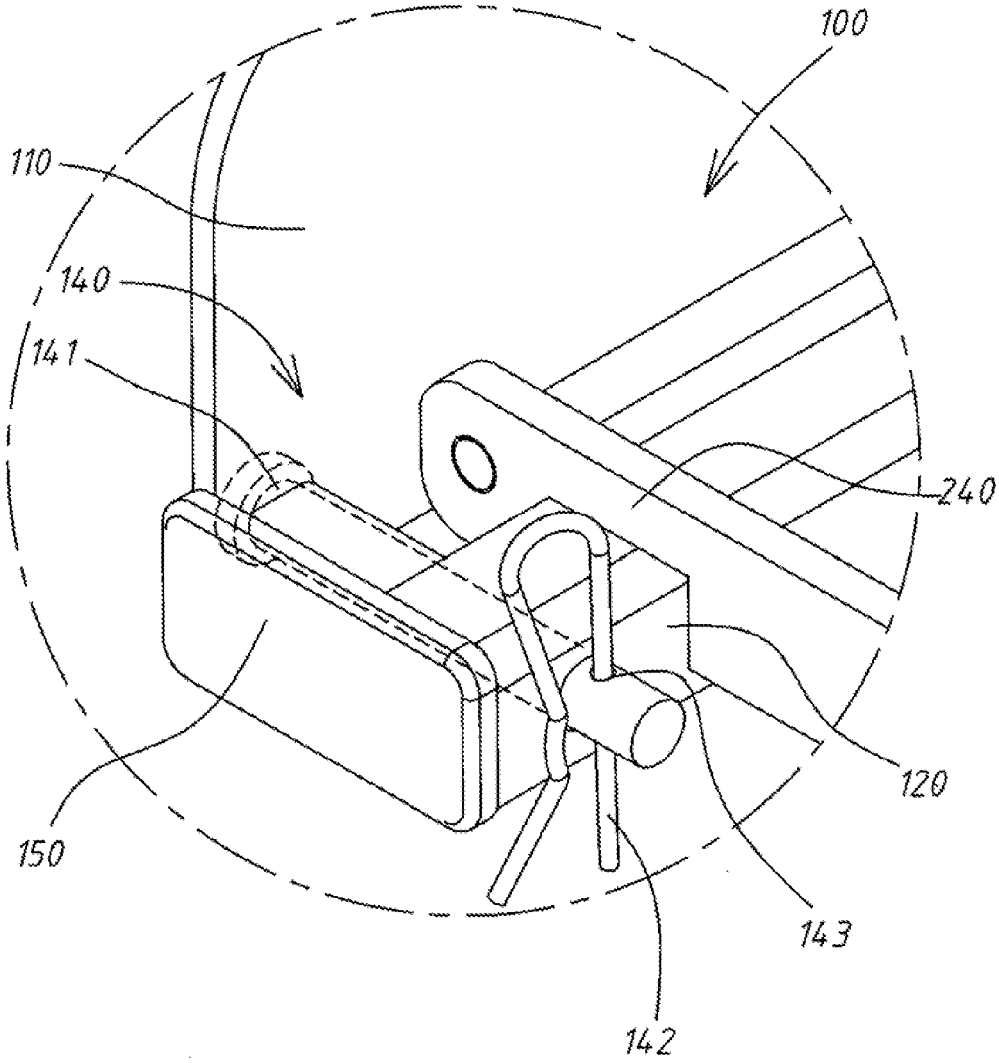
FIG. 5 is a schematic assembled view showing the part B of the ceiling rack illustrated in FIGS. 2 and 4.
Figure 6:
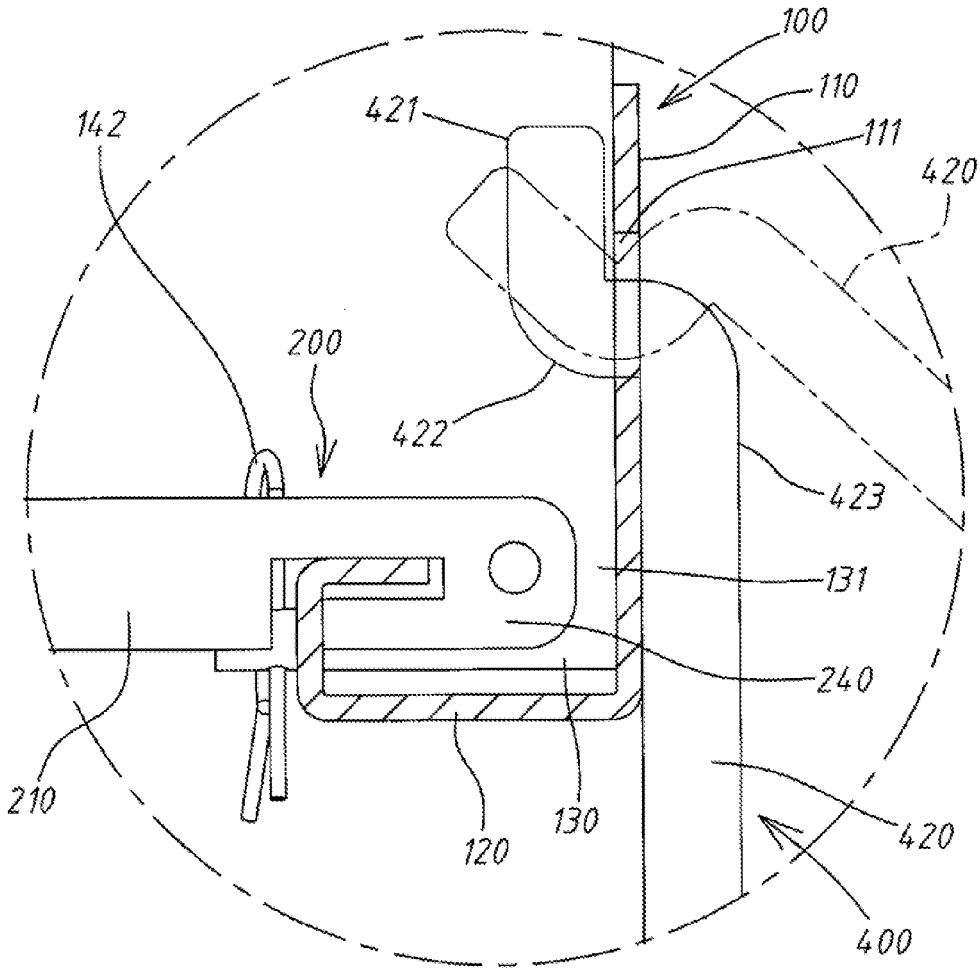
FIG. 6 is a schematic cross-sectional view viewed along line C-C of the ceiling rack illustrated in FIG. 2.
Figure 7:
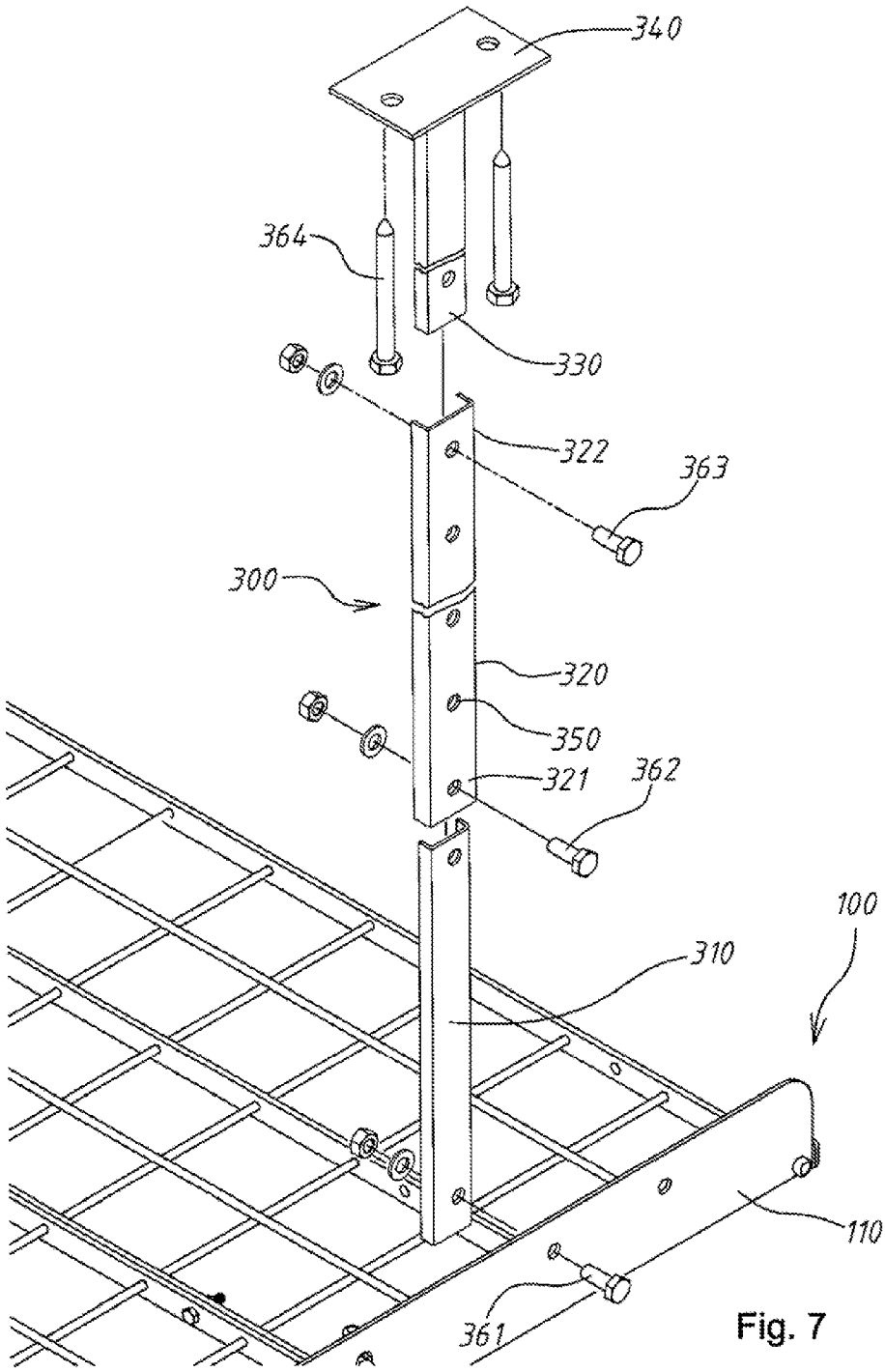
FIG. 7 is a schematic explosive view showing a supporting unit in the ceiling rack illustrated in FIG. 2.

Referring to FIGS. 1-7, the figures respectively show a stereoscopic appearance view, a breakdown view, an enlarged view of a portion and a cross-sectional view of a portion of a ceiling rack, according to an embodiment of the present invention. As shown in the figures, according to an embodiment of the present invention, the ceiling rack includes a pair of transverse beams 100, a plurality of mesh units 200 and four supporting units 300.

The pair of transverse beams 100 is arranged to be parallel to each other. Each transverse beam 100 has a side wall 110 and a U-shaped hook body 120 which are connected with each other. An assembly groove 130 is formed between the U-shaped hook body 120 and the side wall 110, and the assembly groove 130 has an opening 131 on the top surface thereof.

The mesh unit 200 includes a plurality of longitudinal wires 220 and at least two longitudinal struts 210 (three longitudinal struts are illustrated in the embodiment of the accompanying figures, wherein two longitudinal struts are located at two external side positions of the mesh unit, and the other one longitudinal strut is located at a middle position of the mesh unit), wherein the longitudinal struts 210 and the longitudinal wires 220 are parallel to one another. The mesh unit 200 also includes a plurality of latitudinal wires 230 orthogonally crossed with the longitudinal struts 210 and the longitudinal wires 220. The longitudinal struts 210, the longitudinal wires 220 and the latitudinal wires 230 forms a mesh configuration for holding articles (not shown). As to material costs, the longitudinal wire 220 costs less than the longitudinal strut 210, so that a large amount of longitudinal wires are used. However, with respect to the bearing strength, the longitudinal struts 210 has a larger bearing thickness in the bearing direction than the longitudinal wires 220, so that compared with the longitudinal wires 220, the longitudinal struts 210 has a stronger bearing capacity and can complement the insufficient bearing capacity of the longitudinal wires 220. That is, using the longitudinal struts 210 and the longitudinal wires 220 simultaneously can not only reduce the material costs reasonably, but also increase the bearing capacity of the overall mesh unit 200.

A U-shaped end body 240 is formed on each of the two opposite end portions of the longitudinal strut 210. The U-shaped end body 240 can be assembled on the assembly groove 130 of the transverse beam 100 from the end portion of the transverse beam 100 along an axial direction of the transverse beam 100. The U-shaped end body 240 is engaged with the U-shaped hook body 120. The opening 131 of the assembly groove 130 is provided for allowing the turning end portion of the U-shaped end body 240 to pass through and be accommodated therein. Thus, the mesh unit 200 can be joined and fixed with the transverse beam 100 without any locking element, thereby providing the convenience of assembly and disassembly.

Between the adjacent two mesh units 200, the longitudinal struts 210 of the adjacent two mesh units 200 are locked as one body through a plurality of locking units 250, e.g. a bolt, so that the two adjacent mesh units 200 are joined as one body tightly.

To prevent the mesh unit 200 from falling out of the assembly groove 130 of the transverse beam 100, a blocking mechanism 140 is disposed at the end portion of the transverse beam 100. In implementation, the blocking mechanism 140 includes a blocking pin 141 and a fixing pin 142. The blocking pin 141 passes through the side wall 110 and the U-shaped hook body 120 at the end portion of the transverse beam 100, and is protruded from the U-shaped hook body 120. The blocking pin 141 has a pin hole 143 formed thereon for allowing the fixing pin 142 to be inserted into and fixed therein, so that the blocking pin 141 is positioned as a block in the assembly groove 130 of the transverse beam 100. Thus, the blocking of the blocking pin 141 can prevent the mesh unit 200 from falling out of the assembly groove 130.

An end plug 150 is plugged in the assembly groove 130 at the end portion of the transverse beam 100. The end plug 150 is located at the external end of the blocking mechanism 140 for covering the end portion of the assembly groove 130 and maintaining the appearance completeness of the assembly groove.

The supporting unit 300 is assembled between two opposite end portions of the transverse beam 100 and the ceiling (not shown) for suspending the transverse beam 100 and the mesh unit 200. The length of the supporting unit 300 can be adjusted. In implementation, the supporting unit 300 includes a lower supporting member 310, a groove member 320 and an upper supporting member 330. The lower supporting member 310 is fixed on the side wall 110 of the transverse beam 100 through a first fixing element 361. The groove member 320 has a first end portion 321 and a second end portion 322 which are opposite to each other. The first end portion 321 is joined and fixed with the lower supporting member 310 through a second fixing element 362. The upper supporting member 330 is joined and fixed with the second end portion 322 of the groove member 320 through a third fixing element 363. A fixing base 340 is formed on a top end of the upper supporting member 330, and is fixed on the ceiling through a fourth fixing element 364. In addition, a plurality of adjusting holes 350 are formed in the groove member 320. Different sites of the adjusting holes 350 can be aligned and joined with respective holes of the lower supporting member 310 and the upper supporting member 330 through the above fixing elements, thereby adjusting the overall length of the supporting unit 300.

According to an embodiment of the present invention, the ceiling rack further includes two U-shaped frame bodies 400 that are respectively assembled vertically on the side wall 110 of each transverse beam 100. The two U-shaped frame bodies 400 opposite to each other are used to hold articles, so as to increase the accommodation capacity of the ceiling rack.

In an assembly implementation, the U-shaped frame body 400 includes a transverse bar 410 and two arm bars 420 connected with two end portions of the transverse bar. The end portion of the arm bar 420 is an L-shaped end portion, and has an inner arm end 421, a turning arm 422 and an outer arm body 423 which are all connected together. The side wall 110 of the transverse beam 100 has two opposite hook holes 111 formed thereon. After the inner arm end 421 of the U-shaped frame body 400 is inserted into the hook hole 111 of the transverse beam 100, the U-shaped frame body 400 hangs down naturally due to the weight thereof. At this time, the inner arm end 421 resists against the inner wall of the side wall 110 of the transverse beam 100, and the turning arm 422 is disposed across the hook hole 111, and the outer arm body 423 resists against the external wall of the side wall 110. If the U-shaped frame body 400 is desired to be disassembled, the action can be done merely by reversing the process. Thus, the U-shaped frame body 400 can be joined with the transverse beam 100 without any locking element, thereby providing the convenience of assembly and disassembly.

According to an embodiment of the present invention, in the ceiling rack, with the U-shaped end body disposed on the mesh unit, and the U-shaped hook body and the assembly groove disposed on the transverse beam, the mesh unit can be assembled in the assembly groove of the transverse beam and be engaged with the U-shaped hook body without any locking element. The longitudinal strut disposed in the mesh unit can increase the bearing capacity of the mesh unit for holding articles. Moreover, the U-shaped frame body can be added and mounted on the transverse beam without any locking element, and can increase the accommodation capacity. The aim of the present invention is really achieved from what described above.

Although the present invention has been disclosed with reference to the above embodiments, these embodiments are not intended to limit the present invention. It will be apparent to those skilled in the art that various modifications and variations can be made without departing from the scope or spirit of the present invention. Therefore, the scope of the present invention shall be defined by the appended claims.

What is claimed is:

1. A ceiling rack mounted on a ceiling, comprising:

a pair of transverse beams arranged to be parallel to each other, wherein each of the transverse beams has a side wall and a U-shaped hook body connected with each other, and an assembly groove having an opening on a top surface thereof is formed between the U-shaped hook body and the side wall; at least one mesh extending between the pair of transverse beams, the at least one mesh unit having a U-shaped end body at each of the two opposite end portions thereof, wherein the U-shaped end body is assembled in the assembly groove and is matingly engaged with the U-shaped hook body;

at least four supporting units assembled between side walls of the two opposite end portions of the pair of transverse beams and the ceiling to suspend the at least one mesh from the ceiling; wherein the at least one mesh unit comprises at least two longitudinal struts; wherein the U-shaped end body is formed at each of the two opposite end portions of each of the longitudinal struts by an L-shaped slot—; wherein a blocking mechanism is disposed at an end portion of one of the transverse beams; wherein the blocking mechanism comprises a blocking pin and a fixing pin, wherein the blocking pin passes through the side wall and the U-shaped hook body of said one of the transverse beams, and is protruded from the U-shaped hook body, and a pin hole is formed on the blocking pin, and the fixing pin is inserted into and fixed in the pin hole.

2. The ceiling rack of claim 1, wherein the mesh unit comprises a plurality of longitudinal wires parallel to each other, and a plurality of latitudinal wires orthogonally crossed with the longitudinal struts and each of the longitudinal wires.

3. The ceiling rack of claim 2, wherein the number of the at least one mesh unit is more than one, and the at least two longitudinal struts are disposed respectively at two external sides of each of the mesh units, and each of the longitudinal struts of every two adjacent mesh units is locked as one body through at least one locking element.

4. The ceiling rack of claim 2, wherein the at least four supporting units each comprise:

a lower supporting member fixed on the side wall of one of the transverse beams through a first fixing element;

a groove member having a first end portion and a second end portion opposite to each other, wherein the first end portion is joined and fixed with the lower supporting member through a second fixing element; and an upper supporting member joined and fixed with the second end portion of the groove member through a third fixing element, wherein a fixing base is formed on a top of the upper supporting member and is fixed on the ceiling through a fourth fixing element.

5. The ceiling rack of claim 4, wherein a plurality of adjusting holes are formed on the groove member.

6. The ceiling rack of claim 1, wherein an end plug is plugged in the assembly groove at the end portion of the transverse beam, and the end plug is located at an external end of the blocking mechanism.

7. The ceiling rack of claim 1, further comprising at least two U-shaped frame bodies respectively assembled vertically on the side wall of each of the transverse beams.

8. The ceiling rack of claim 7, wherein two hook holes are formed on the side wall of each of the transverse beams, and the U-shaped frame body comprises a transverse bar and two arm bars connected with the two end portions of the transverse bar, wherein the end portion of each arm bar is an L-shaped end portion and has an inner arm end, a turning arm and an outer arm body connected with each other, wherein the inner arm end is inserted into the hook holes and rests against an inner wall of the side wall, the turning arm is disposed across the hook hole, and the outer arm body rests against an external wall of the side wall.

* * * * *